United States Patent [19]

Potthof

[11] Patent Number: 4,595,967

[45] Date of Patent: Jun. 17, 1986

[54] ELECTRONIC CONTROL CIRCUIT FOR THE PERFORMING OF A MONOSTABLE SWITCHING FUNCTION IN A BISTABLE RELAY

[75] Inventor: Erwin Potthof, Rothenbach, Fed. Rep. of Germany

[73] Assignee: Diehl GmbH & Co., Fed. Rep. of Germany

[21] Appl. No.: 570,178

[22] Filed: Jan. 12, 1984

[30] Foreign Application Priority Data

Jan. 21, 1983 [DE] Fed. Rep. of Germany ..... 3301866

[51] Int. Cl.[4] ..... H01H 47/32

[52] U.S. Cl. ..... 361/152; 361/160; 361/190; 361/208

[58] Field of Search ..... 361/139, 152, 153, 154, 361/160, 167, 168.1, 169.1, 186, 190, 194, 195, 196, 198, 208, 245, 246; 335/78, 79; 307/132 E, 127

[56] References Cited

U.S. PATENT DOCUMENTS

| | | | |
|---|---|---|---|
| 3,019,374 | 1/1962 | Ladd, Jr. | 361/152 |
| 3,931,550 | 1/1976 | Dalpee | 361/186 |
| 4,078,528 | 3/1978 | Hoshi | 361/160 X |
| 4,385,339 | 5/1983 | Takada et al. | 361/154 |

OTHER PUBLICATIONS

"Engineer's Relay Handbook"—Hayden Book Co., Inc., p. 245 ©1966, 1969.

*Primary Examiner*—Harry E. Moose, Jr.
*Attorney, Agent, or Firm*—Scully, Scott, Murphy & Presser

[57] ABSTRACT

An electronic circuit for the performing of a monostable switching function in a bistable relay through the conversion of binary input signals into control signals for the bridge switching circuit consisting of two bridge branches with complementary operating electronic switches. The flow direction of the current is reversible in the relay through intermediary of the bridge switching circuit, and the relay is switchable at each change in the level of the input signal through a pulse with a predetermined energy content.

3 Claims, 3 Drawing Figures

ELECTRONIC CONTROL CIRCUIT FOR THE PERFORMING OF A MONOSTABLE SWITCHING FUNCTION IN A BISTABLE RELAY

BACKGROUND OF THE INVENTION

1. Field of the Invention

The present invention relates to an electronic circuit for the performing of a monostable switching function in a bistable relay through the conversion of binary input signals into control signals for the bridge switching circuit consisting of two bridge branches with complementary operating electronic switches, whereby the flow direction of the current is reversible in the relay through intermediary of the bridge switching circuit, and the relay is switchable at each change in the level of the input signal through a pulse with a predetermined energy content.

2. Discussion of the Prior Art

Control circuits of that type are currently known in the technology. For instance, in U.S. Pat. No. 4,455,587, which is assigned to the common assignee of the present application, there is described an electronic control circuit of that type in which a bistable relay performs a monostable switching function. In this control circuit, control pulses which are adapted for a bridge circuit are generated through the intermediary of a relatively complex logic circuit, which presently connects the exciter windings of the bistable relay for the duration of the control pulse with the two poles of a voltage source. This will then determine the flow direction of the current through the exciter windings by means of an input signal which is applied to the electronic circuit.

Moreover, the electronic control circuit disclosed in U.S. Pat. No. 4,455,587 possesses further special capabilities, such as the pulse-synchronous switching of the relay, or also the formation of special "regenerating pulses".

However, there is also currently evident a need for simpler circuits which serve exclusively for the performing of a monostable switching function in a bistable relay, especially for the purpose of savings in energy.

A circuit of that type is also described in the data sheet of the SDS-Electro GMBH concerning its Module IC-12 V, or respectively, IC-24 V. Hereby, a bistable relay is connected in series with a capacitor, wherein the capacitor must be of such size that the capacitance of the capacitor produces a charging time constant, in conjunction with the winding resistance of the relay, which at least as large as the response time of the relay. Obtained thereby, particularly in the control of relays with a high switching rating (pursuant to the data sheet, page 2), capacitance values of up to a few hundred microfarads.

SUMMARY OF THE INVENTION

Accordingly, it is an object of the present invention to provide an electronic circuit as described hereinabove, wherein a bridge branch of the bridge circuit has the input signal applied thereto, wherein a delay circuit is connected ahead of the other bridge branch, and in which the input signal is applied to the delay circuit.

Moreover, it is an object of the present invention to provide a simple, uncomplicated and inexpensively produced control circuit which will perform a monostable switching function also in a bistable relay. Thereby, in particular, avoided is the employment of large capacitors in the microfarad range.

Consequently, by means of the delay circuit which, in the simplest instance, can be constructed as an RC-circuit, there can be achieved that the bridge branch of the bridge circuit which is controlled thereby will switch over, at a predeterminable time period subsequent to the directly-controlled bridge branch, into the presently reverse switching position. When the bridge branches are designed so as to be identical, then a flow of current through the bistable relay which is connected to the bridge circuit will presently take place only during the delay time period. Through suitable sizing of the delay circuit; in effect, the particularly advantageous RC-circuit, in the simplest manner there can be so set the duration of the flow of current, as to ensure the switching over at a minimum energy requirement. Thereby, for the capacitor of a RC-circuit only relatively small capacitance values in the range of microfarads are necessary, inasmuch as the capacitor will control only one or possibly two transistors.

Through the use of driver transistors for the amplification of the control signals, there can be achieved a significant improvement in the switching precision of the relay. A circuit of that type is particularly advantageous when the switching of the relay is of criticality in time.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
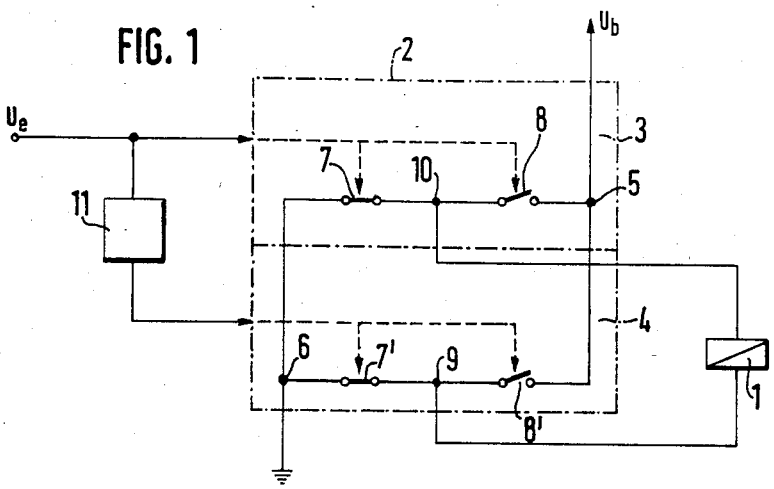
FIG. 1 illustrates a circuit block diagram of the inventive electronic control circuit.

Illustrated in FIG. 1 is a circuit block diagram of an electronic control circuit for the performing of a monostable switching function in a bistable relay 1. The relay 1 is hereby actuated by a schematically illustrated bridge circuit 2. The bridge circuit consists of two identical bridge branches 3, 4 which are connected in parallel, and whose connecting points 5, 6 are connected to a voltage source (identified by $U_b$ and the ground symbol). Each of the two bridge branches 3, 4 consists of two series-connected electronic switches 7, 7', 8, 8', which are electrically controllable and which operate in a complementary mode. The two connecting points 9, 10 for the bistable relay 1 are located between these series-connected switches 7, 7', 8, 8'. Preferably, bipolar or field-effect transistors can be utilized as the electronic switches 7, 7', 8, 8'.

The electronic switches 7, 7', 8, 8' of respectively one of the two bridge branches 3, 4 are controlled by means of the same signal. In the one bridge branch 3 this signal is identical with the binary input signal $U_e$. The other bridge branch 4 is actuated through a delay switching circuit 11. This delay switching circuit 11 is designed to conduct along the present level of the input signals $U_b$ at a certain predeterminable delay. Thereby, the delay period is determined by the energy requirement which the relay 1 necessitates for a switching procedure. This is elucidated in closer detail hereinbelow on the basis of the function of the circuit.

Since the electronic switches 7, 7', 8, 8' of presently one of the two identically constructed bridge branches 3, 4 operate in a complementary mode, in one bridge branch 3, 4 there is present open one electronic switch 7, 7' 8, 8' and one switch is closed. At a constant input signal $U_b$, and after the completion of the delay period of the delay switching circuit 11, the switching positions of the electronic switches 7, 7', 8, 8' are the same in both bridge branches; in effect, the two connecting points 9, 10 of the bistable relay 1 are at the same potential; for example, at ground. When the input signal $U_e$ changes then, in the directly controlled bridge branch 3, the two electronic switches 7, 8 will immediately switch into their respective other switching condition. The associated connecting point 10 of the relay 1 is thereby now at another potential; for example, the operating potential $U_b$ in contrast with the other connecting point 9, so that a current will flow through a relay 1. This condition is maintained until the delay time period which is predetermined by the delay circuit 11 has been traversed. Thereafter, the new input signal $U_e$ will also be present at the electronic switches 7', 8' of the bridge branch 4 which has been actuated by means of the delay circuit, whereby also these electronic switches 7', 8' switch into their other respective switching condition. Both connecting points 9, 10 of the bistable relay 1 are now again at the same potential, for instance at the operating potential $U_b$, so that current will no longer flow through the relay 1.

When the input signal $U_e$ changes back to its initial condition, then the connecting point 10 in the directly controlled bridge branch 3 is switched to ground potential, whereas the connecting point 9 of the bridge branch 4 is controlled through the delay circuit still remains at the operation potential $U_b$ during the preset delay period. The current which flows through the relay during the delay period will, subsequently, flow in the opposite direction so that the relay 1 is switched back into its initial position. Through the selection of a predetermined delay period there can thus be preset the duration of the flow of current subsequent to each level change of the input signal $U_e$, and the circuit is correlated with the presently employed bistable relay 1.

Figure 2:
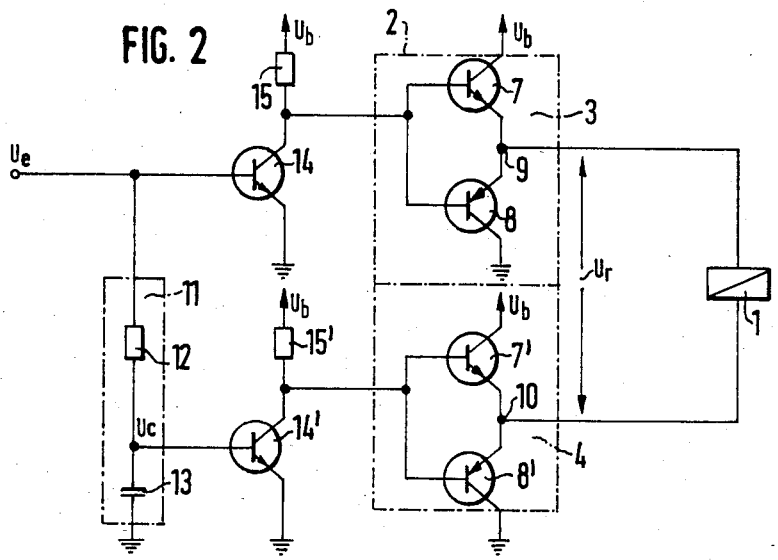
FIG. 2 illustrates a preferred embodiment of the electronic circuit.

FIG. 2 illustrates a preferred exemplary embodiment, in which an RC-circuit consisting of a resistor 12 and a capacitor 13 is employed as a delay circuit 11.

In this exemplary embodiment, a driving transistor 14, 14' in an emitter circuit with respectively a collector resistor 15, 15' is presently connected ahead of the two bridge branches 3, 4 of the bridge circuit 2 to provide for amplification of the control signals. The control signals consist of the input signal $U_e$ for the directly controlled bridge branch 3, and of the voltage $U_e$ which is presently applied to at the capacitor 13. Hereby, the capacitor 13 is supplied with the input signal $U_e$ through the resistor 12, so that the voltage $U_c$ will, at a change of the input signal $U_e$, follow the latter with a delay which is predetermined by the values of the capacitor 13 and of the resistor 12.

The bridge circuit 2 consists of two identically constructed bridge branches 3, 4 which, in this preferred exemplary embodiment pursuant to FIG. 2, are each combined from two complementary bipolar transistors as electronic switches 7, 7', 8, 8'. The collector-emitter section of these complementary transistors are connected in series, whereby the two emitters are interconnected, and form the connecting points 9, 10 of the bridge circuit 2 for the bistable relay 1. The collectors of the presently identical transistors of the two bridge branches 3, 4 are joined together, and are connected to the operating potential $U_b$ or to ground potential. The bases of the transistors of respectively one bridge branch 3, 4 are interconnected and are actuated by the driving transistors 14, 14'.

Figure 3:
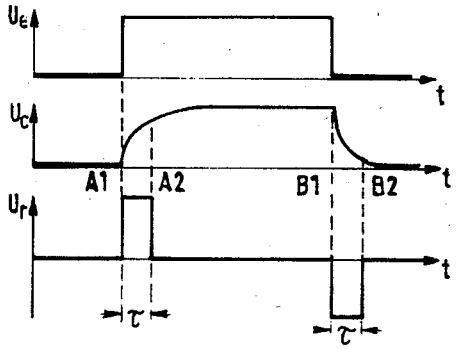
FIG. 3 illustrates voltage-time waveforms for different points in the circuit of FIG. 2.

Represented in FIG. 3 are three voltage-time waveforms for a control circuit embodiment pursuant to FIG. 2. The first waveform represents a voltage cycle for the input signal of $U_e$ whereby at time point A1, a switchover occurs from level "Low" to level "High" and at time point B1 from level "High" to level "Low". The second waveform illustrates the cycle of the voltage $U_c$ which is applied to the capacitor 13. Commencing from the switching time point A1 of the input signal, the capacitor 13 charges at a charging time constant which is predetermined by the RC-circuit combination 12, 13, until it has reached the level "High". At the second switching timepoint B1, the capacitor 13 begins to correspondingly discharge until the voltage $U_c$ has reached the level "Low". At predetermined voltages $U_c$ presents at the capacitor 13 (dependent upon the design of the bridge circuit 2 and of the amplifier stages with the driving transistors 14, 14'), there also switches over the branch 4 which is actuated through the delay circuit 11. These switching points are identified in FIG. 3 by designations A2 and B2. The time interval between these switching points A1, A2 and B1, B2 is the delay period, during which the bistable relay 1 is supplied with voltage through the bridge circuit 2. The voltage $U_r$ which is applied to the relay 1 is supplied with voltage in conjunction with each change in level of the input signal $U_e$ over the time period $\tau$, which is variable through a change in the values of the resistor 12 and the capacitor 13, whereby the polarity of the voltage is dependent upon the direction of the level change of the input signal $U_e$. The time period $\tau$, even for a relay 1 with a high switching capacity, consists maximally of only up to about 50 ms so that, at a value of 200 kΩ for the resistor 12, values in the magnitude of 300 nf are adequate for the capacitor 13. Smaller relays 1 require correspondingly smaller capacitors 13.

What is claimed is:

1. In an electronic control circuit for the performing of a monostable switching function in a bistable relay through the conversion of binary input signals to control signals, said circuit comprising:

a bistable relay, a bridge circuit including two bridge branches for reversing the direction of current flow to the relay, each of the bridge branches having two complementary operating electronic switches, said bridge branches act together to alternately apply and remove a voltage potential across the relay in response to a level change in the input signal, a first of said bridge branches being coupled to an input terminal for said input signal, a delay circuit coupled between the input signal terminal and a second of said bridge branches for supplying the input signal to said second bridge branch at a predetermined time after the input signal is applied to said first bridge branch whereby the relay is switched over at each level change in the input signal in response to a voltage pulse supplied to the relay having a time period determined by the delay circuit.

2. An electronic control circuit as claimed in claim 1 comprising driving transistors connected ahead of the bridge branches of said bridge circuit to provide for amplification of the control signals.

3. An electronic control circuit as claimed in claim 1, wherein said delay circuit comprises the combination of a resistor and a capacitor, the input signal being supplied to said capacitor through said resistor to actuate the second bridge branch through the voltage applied to the capacitor.

* * * * *